United States Patent [19]

Kisler

[11] Patent Number: 4,517,143

[45] Date of Patent: May 14, 1985

[54] METHOD AND APPARATUS FOR UNIFORMLY CHARGING A MOVING WEB

[75] Inventor: Semyon Kisler, West Newton, Mass.

[73] Assignee: Polaroid Corporation, Cambridge, Mass.

[21] Appl. No.: 538,221

[22] Filed: Oct. 3, 1983

[51] Int. Cl.[3] ..... H05F 3/00

[52] U.S. Cl. ..... 264/22; 264/24; 361/213; 361/221; 361/225; 425/174.8 E; 427/13

[58] Field of Search ..... 264/22, 24, 26, 104; 425/174.8 E; 427/13; 361/213, 225, 221

[56] References Cited

U.S. PATENT DOCUMENTS

| | | | |
|---|---|---|---|
| 2,641,025 | 6/1953 | Busby, Jr. | 264/24 |
| 2,802,085 | 8/1957 | Rothacker | 264/26 |
| 2,908,545 | 10/1959 | Teja | 264/22 |
| 2,952,559 | 9/1960 | Nadeau | 427/13 |
| 3,634,726 | 1/1972 | Jay | 264/22 |
| 3,671,806 | 6/1972 | Whitmore et al. | 361/221 |
| 3,730,753 | 5/1973 | Kerr | 427/13 |
| 4,363,070 | 12/1982 | Kisler | 361/221 |
| 4,383,752 | 5/1983 | Kisler | 361/225 |
| 4,402,035 | 8/1983 | Kisler | 361/213 |
| 4,412,960 | 11/1983 | Goldman et al. | 264/22 |

FOREIGN PATENT DOCUMENTS

| | | | |
|---|---|---|---|
| 51-41762 | 4/1976 | Japan | 264/22 |
| 51-41763 | 4/1976 | Japan | 264/22 |
| 55-148128 | 11/1980 | Japan | 264/22 |
| 57-207024 | 12/1982 | Japan | 264/26 |
| 883218 | 11/1961 | United Kingdom | 264/22 |
| 1100414 | 1/1968 | United Kingdom | 264/22 |

*Primary Examiner*—Jeffery Thurlow
*Attorney, Agent, or Firm*—John J. Kelleher

[57] ABSTRACT

Method and apparatus for establishing a uniform charge level on a randomly charged web having both positive and negative, bounded and/or free electrostatic charges. The method and apparatus include first and second uniform electrostatic fields of different magnitudes and of opposite polarities that are spaced from one another. Apparatus is provided for passing the randomly charged web through the first electrostatic field with a particular magnitude and polarity to either neutralize or change the polarity of either the positive or negative electrostatic web charges and then subsequently through the second electrostatic field with its different magnitude and its opposite polarity to either neutralize or change the polarity of the web charge present after exiting from the first electrostatic field to thereby adjust the electrostatic charge level to the desired uniform magnitude.

17 Claims, 3 Drawing Figures

METHOD AND APPARATUS FOR UNIFORMLY CHARGING A MOVING WEB

BACKGROUND OF THE INVENTION

The present invention relates to the uniform charging of randomly charged materials, in general, and to the neutralization of random bounded and free electrostatic charges on a moving web of such materials, in particular.

Random bounded and/or free electrostatic charges on a web can produce a number of product quality damaging web coating problems. Bounded charges are sometimes referred to as polarization or polar charges whereas free charges are commonly referred to as surface charges. In the photographic industry, for example, a significant non-uniform thickness distribution of a photographic coating material often results when such material is applied to a randomly charged web. Because of the high surface resistivity of present day high dielectric materials such as polyester based materials and the like employed in photographic film, it is fairly common to have relatively high polarization and surface charge levels, of varying intensity and polarity, occupying web areas closely adjacent one another. The use of such coating materials as a component of a photographic positive or negative, for example, often requires the use of relatively thick coatings to provide at least a minimum thickness coating throughout the web and thereby compensate for such non-uniform thickness distribution which necessarily results in an increase in the use of relatively costly photographic coating materials in order to produce an effective coating thickness. Visual effects such as photographic mottle are also a consequence of coating non-uniformly charged webs with photographic coating materials. Past practices included either tolerating this non-uniform charge distribution and its attendant disadvantages or attempting to neutralize a randomly charged web as much as possible prior to applying the photogrphic coating materials.

One technique described in U.S. Pat. No. 2,952,559 to NADEAU, involves passing a charged web between a pair of opposed grounded pressure rollers that are spring-force biased against opposite web surfaces for the purpose of neutralizing bounded or polarization-type electrostatic charges and then blowing ionized air onto surfaces of the web to first neutralize surface charges and then establish a particular web surface charge level prior to coating same. This resulting surface charge level is compensated for by applying a voltage to the coating applicator during the actual coating process having a polarity that is opposite to that of the web surface charge.

Another technique desribed in U.S. Pat. No. 3,730,753 to KERR involves "flooding" a web surface with charged particles of a first polarity so as to generally uniformly charge the surface and thereafter removing the charge imparted to said web surface so as to leave the surface generally free of charge. The amount of charge added to and/or the amount of charge removed from the web surface may be so controlled that the charge variation and the net charge on the surface is lowered to an acceptable low level.

While blowing ionized air onto a charged web surface or "flooding" same with charged particles are effective techniques for neutralizing unbounded or free surface charges they have a very limited effect on the control or neutralization of bounded or polarization charges. Neutralization of bounded or polarization charges in materials having relatively low surface resistivity (less than $1\times10^{13}$ ohms$^2$ per square) such as paper materials and the like, with a pair of opposed grounded pressure rollers pressing on opposite sides of the paper materials as shown in the above-cited NADEUA patent, may be effectively accomplished. However, when opposed pressure rollers are used with relatively high-dielectric materials such as polyester based materials and the like, the lowest polarization-type electrostatic charge level obtainable with such apparatus is in the range of 500–800 volts.

The primary object of the present invention is, therefore, to provide a method and apparatus for uniformly charging randomly charged materials having relatively high surface resistivity.

Another object of the present invention is to provide a method and apparatus for neutralizing bounded and unbounded random electrostatic charges on a randomly charged web.

A further object of the present invention is to provide a method and apparatus for establishing a uniform positive, negative or neutral electrostatic charge level on a randomly charged moving web.

Other objects, features and advantages of the present invention will be readily apparent from the following description of the preferred embodiment thereof taken in conjunction with the accompanying drawings.

SUMMARY OF THE INVENTION

In accordance with the teachings of the present invention, a method and apparatus is provided for uniformly charging an electrostatically chaged web having random bounded and unbounded electrostatic charges of opposite polarity and of different magnitude non-uniformly distributed throughout. The method and apparatus include first and second relatively uniform electrostatic fields having different magnitudes, of opposite polarities and physically spaced from one another. Means are provided for initially moving the randomly charged web through the first electrostatic field with its particular magnitude and polarity to convert all of said random charges to the same or neutral polarity and subsequently moving said electrostatically charged web through said second electrostatic field with a different magnitude and opposite polarity to thereby produce a uniformly charged web of uniform magnitude and of either positive, negative or neutral polarity.

DESCRIPTION OF THE PREFERRED EMBODIMENTS

Figure 1A:
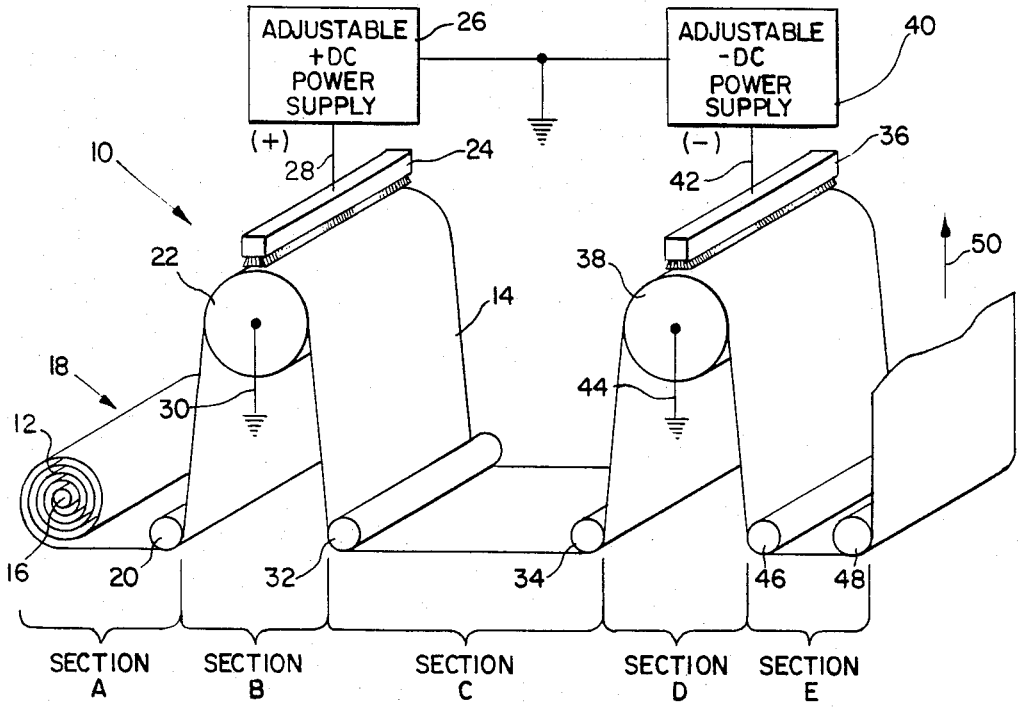
FIG. 1A is a schematic diagram of a preferred embodiment of the electrostatic charge controlling apparatus of the present invention.

In FIG. 1A of the drawings, web charge controlling apparatus 10 incorporating a preferred embodiment of the present ivention, is depicted. As shown in FIG. 1A, roll 12 of relatively high-dielectric polyester base material 14 is rotatably supported on mandrel 16 at unwind station 18. The term "dielectric" as used herein means as it is generally understood to mean, a material having a surface resistivity equal to or greater than $1\times10^{13}$ ohms per square. Web 14 is initially unwound from roll 12 at unwind station 18 by drive means (not shown) coupled to said web 14, is moved over idler roller 20 and then over cylindrical metal roller 22 through the space between the ends of the bristles of conductive bristle brush 24 and said metal roller 22. One surface of web 14 is in intimate contact with a portion of the outer surface of commonly grounded roller 22 with the opposed or opposite web surface being spaced a finite distance from the free ends of said conductive bristle brush 24. The bristles of brush 24 are made of stainless steel, are approximately 50 microns in diameter and are electrically connected to one another. An example of a conductive bristle brush of the type employed in the charge controlling apparatus of the present invention is shown in U.S. Pat. No. 4,402,035 to KISLER. Each of the conductive bristles of conductive bristle brush 24 is conected to adjustable +DC power supply 26 through path 28 and metallic roller 22 is connected to zero potential system ground through path 30. After exiting from between brush 24 and roller 22, web 14 is moved over idler rollers 32 and 34, respectively, and then through the space between conductive bristle brush 36 and cylindrical metal roller 38. One surface of web 14 is in intimate contact with a portion of the outer surface of roller 38 with the opposed or opposite web surface being spaced a finite distance from the free ends of said conductive bristle brush 36. The construction of brush 36, including the materials employed therein, is identical to the construction of previously described conductive bristle brush 24. Each of the conductive bristles of conductive bristle brush 36 is connected to adjustable −DC power supply 40 through path 42 and metallic or conductive roller 38 is connected to system ground through path 44. After exiting from between brush 36 and grounded roller 38, web 14 is moved over idler rollers 46 and 48, respectively, and then in direction 50 to, for example, a rewind station (not shown) where it would be rewound for subsequent storage or to a workstation for further processing such as a station where a coating fluid is applied to the web by a coating applicator.

In order to produce a uniform charge level on a randomly charged web such as randomly charged web 14 in drawing FIG. 1A, both the magnitude and polarity of the outputs of adjustable power supplies 26 and 40 must be manually adjusted to produce the desired uniform web charge level. The term "uniform charge" as used herein means a bounded and/or unbounded electrostatic charge of constant magnitude and of either positive, negative or neutral polarity that is uniformly distributed throughout a particular material or combination of materials. Also, the term "random charge" as used herein means a non-uniform distribution of adjacent bounded and/or unbounded electrostatic charges of the same or opposite polarity and of different charge level magnitudes. In order to establish a uniform positive charge level on a randomly charged web with charge controlling apparatus 10, it is essential that a negative voltage be applied to conductive bristle brush 24 by power supply 26 followed by a positive voltage being applied to conductive bristle brush 36 by power supply 40 as the randomly charged web is moved from brush 24 to brush 36. Conversely, to establish a uniform negative charge level on a randomly charged web, a positive voltage must be initially applied to conductive bristle brush 24 followed by a negative voltage being applied to conductive bristle brush 36 as the randomly charged web is moved from brush 24 to brush 36. To neutralize a randomly charged web with the apparatus of FIG. 1A, the order in which the polarity of the voltage is applied to conductive bristle brushes 26 and 28 is immaterial.

Figure 1B:
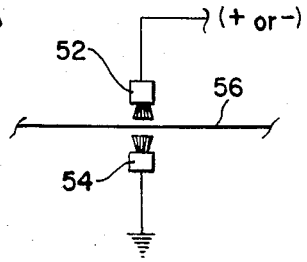
FIG. 1B is an alternate embodiment for one or both of the electrostatic field generating electrode pairs shown in drawing FIG. 1A.

In some applications, it may not be technically possible to employ a grounded metallic roller such as rollers 22 and 38 as one of the electrostatic charge controlling electrodes in the charge controlling apparatus of FIG. 1A. In such application, the rollers must often be maintained at some positive or negative voltage level in order to be compatible with certain extrinsic operating conditions imposed on said charge controlling apparatus by the equipment on which it is employed. In an application where the use of a grounded metal roller cannot be used for charge controlling purposes for reasons such as those mentioned above, the brush 24/roller 22 combination and/or the brush 36/roller 38 combination would be replaced by the two-brush arrangement shown in drawing FIG. 1B. In FIG. 1B, a pair of conductive bristle brushes 52 and 54 are mounted in a fixed position on opposite sides of randomly charged web 56 with each brush having its bristle ends spaced a finite distance from an adjacent web 56 surface. With this configuration, conductive bristle brush 52 would be electrically connected to a positive or a negative power supply having a predetermined voltage level and brush 54 would be electrically connected to system ground. The electrostatic field established between brushes 52 and 54 would be capable of neutralizing or charging a randomly charged web, but the charge distibution would not be as uniform as that produced by the brush-/roller combination employed in the apparatus of FIG. 1A because the electrostatic field produced by a two-brush configuration with its less uniform bristle tip to bristle tip spacing is inherently less uniform than that produced by a single brush in combination with a metal roller and its more uniform bristle tip to metal roller spacing.

Conductive bristle brushes 24 and 36 include a multiplicity of electrically conductive bristles, preferably of stainless steel, with each of said bristles having a diameter of approximately 50 microns. One end of each of the bristles is electrically connected to one another and the opposite or free ends of each of the bristles ideally extend a distance from the commonly connected ends that is sufficient to form a plane with the bristle tips. When a voltage is connected between the conductive bristles and a conductive reference surface, a relatively intense and uniform electrostatic field is established between the tips of the conductive bristles and said reference surface. The small bristle diameter makes possible the generation of this relatively intense electrotatic field with voltages that are well below that necessary for the generation of corona, voltages that are normally within the range of from 1,000 to 2,000 volts. The intensity of the electrostatic field is primarily dependent upon bristle to reference surface voltage, bristle diameter and the distance between a bristle tip and a conductive reference surface such as the conductive outer surfaces of rollers 22 and 38 in drawing FIG. 1A. Even though an attempt is made to terminate the bristel tips in a planar configuration in order to maintain a constant bristle tip to reference surface distance for all bristle tips, bristle length manufacturing limitations prevent such a configuration for a relatively small fraction of the total number of bristle tips. However, bristle length differences can be compensated for by increasing the brush dimension and therefore the number of brush bristles in the direction of web movement. Compensating for differences in bristle length by increaseing said brush dimension is less effective for the opposed brush arrangement of FIG. 1B because of the variation in bristle length of both oppositely facing brushes where the tips of neither form the desired uniform reference surface.

OPERATION

As noted above, the charging apparatus of the present invention may be employed to produce a positive, negative or neutral electrostatic charge on a web of randomly charged material. The apparatus is particularly effective on dielectric materials (as defined above) and is effective in controlling both bounded or polar charges and unbounded or free charges. For the purpose of describing the operation of the preferred embodiment of the present invention shown in drawing FIG. 1A, it is assumed that randomly charged web 14 is a 3 mil thick relatively high dielectric polyester base material that has both positive and negative bounded and unbounded electrostatic charges thereon and that a uniform −200 V negative charge level is to be established on said polyester web 14.

Figure 2:
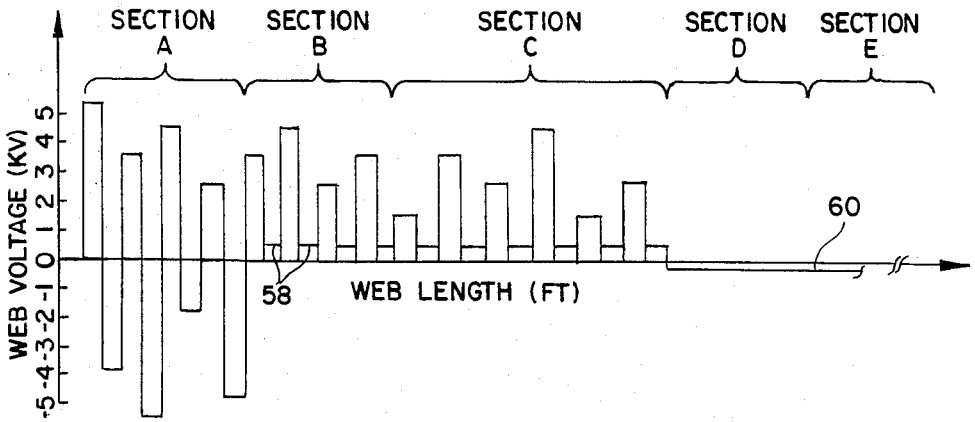
FIG. 2 is a graph of the changes that occur in the electrostatic charge level of a randomly charged web as it is moved through the charge controlling apparatus of the present invention shown in drawing FIG. 1A.

With reference to both FIGS. 1A and 2 of the drawings, prior to establishing the desired uniform electrostatic charge level on randomly charged polyester base web 14, the output voltages of adjustable DC power supplies 26 and 40 must be adjusted to the DC voltage levels that will produce uniform −200 V web charge level. For the 3 mil polyester base material web 14 it has been empirically determined that +DC power supply 26 must be adjusted to +1,000 V and −DC power supply 40 must be adjusted to approximately −700 V. Once the above voltage levels have been established, web 14 is moved by conventional drive means (not shown) coupled to said web 14 through section A of web charging apparatus 10 over idler roller 20 and then through the gap between the free ends of the bristles of conductive bristle brush 24 and the cylindrical outer surface of grounded metal roller 22. As shown in the graph of web voltage as a function of web length in drawing FIG. 2, in section A web 14 has some electrostatic charges thereon in excess of + and −5 KV. Electrostatic charge magnitude and location are random throughout that portion of web 14 moving through said section A. Web 14 is subsequently moved through section B and through the gap between brush 24 and conductive roller 22. With +1,000 VDC connect between brush 24 and roller 22 an extremely intense and relatively uniform electrostatic field is established between the free ends of the bristles of brush 24 and roller 22 and within web 14 as it is moved through said gap in intimate contact with roller 22 but spaced a finite distance from the conductive bristles of brush 24. As web 14 moves through this intense electrostatic field, all of the negative electrostatic charges are converted to a positive charge level of approximately +800 V (58). The +1,000 VDC output voltage from power supply 26 across brush 24 and roller 22 is of sufficient magnitude to convert all of these random negative charges to +800 V even though many of these charges may be well in excess (more negative than) −5,000 V. This is so because the +1,000 volts from the power supply 26 connected between brush 24 and roller 22 provides substantially more dipole-turning charge-controlling energy to the electrostatic field established between said brush 24 and roller 22 than is available from these relatively large magnitude electrostatic charges to resist said charge-controlling energy. This common polarity random magnitude electrostatic charge level does not change further as it moves completely through sections B and C of web charging apparatus 10. Web 14 is then moved through section D and through the gap between brush 36 and conductive roller 38. With −700 VDC connected between brush 36 and roller 38, a second relatively intense electrostatic field is established between brush 36 and roller 38 and in web 14 as it is moved through said gap in intimate contact with roller 38, but spaced a finite distance from the conductive bristles of brush 36. As web 14 is moved through this second electrostatic field, all of the positive electrostatic charges are converted to the desired negative charge level of −200 V (60). The −700 VDC output voltage from power supply 40 across brush 36 and roller 38 is sufficient to convert all of the common polarity, random magnitude charges to −200 V (including the +800 V charges created by the first electrostatic field) even if these random charges are well in excess of +5,000 V for the same reasons given above for being able to reverse the polarity of large magnitude negative charges. Web 14 with its −200 V bounded or polar-type electrostatic charge is then moved over idler rollers 46 and 48 in direction 50 to either a web coating applicator or to a conventional rewind station for subsequent storage. Any random unbounded or free surface charges on web 14 while in unwind station 18 are removed or are bled from the surface of web 14 adjacent brushes 24 or 36 as it moves through the electrostatic field generated, in part, by these two conductive bristle brushes. Unbounded or free charges on the opposite surface of web 14 are removed by grounded rollers 22 or 38.

To place a uniform positive electrostatic charge of the polar or bounded type on web 14, the order of the polarity of the voltages applied to conductive bristle brushes 24 and 36 would be reversed as previously explained. The magnitude of the negative voltage applied to brush 24 to produce a final positive charge level in web 14 would be the same as that applied to said brush 24 to produce the above-described negative charge level. However, the magnitude of the final or positive voltage applied to brush 36 would depend upon the charge level magnitude desired. To neutralize random charges on web 14 or any other web made of different (dielectric or nondielectric) materials and/or having different web material thicknesses would have opposite polarity voltages successively applied to conductive bristle brushes 24 and 36, respectively, in approximately a two-to-one ratio.

It will be apparent to those skilled in the art from the foregoing description of my invention that various improvements and modifications can be made in it without departing from its true scope. The embodiments described herein are merely illustrative and should not be viewed as the only embodiments that might encompas my invention.

What is claimed is:

1. Apparatus for establishing a uniform electrostatic charge level on a web of material having random bounded-type electrostatic charges thereon, comprising:

means for generating a first electrostatic field of predetermined intensity and polarity at a particular spatial location;

means for establishing a second electrostatic field of different intensity and of opposite polarity with respect to said first electrostatic field at a different spatial location; and means for initially moving said randomly charged web through said first electrostatic field for the purposes of changing the polarity of either the positive or the negative random bounded-type electrostatic web charges and subsequently moving said web from said first electrostatic field and through said second electrostatic field to change the polarity of the electrostatic charge on said web after exposure to said first electrostatic field and to thereby produce a uniform electrostatic charge level on said moving web.

2. The apparatus of claim 1, wherein each of said first and second electrostatic field generating means includes a conductive bristle brush electrode and a conductive reference surface electrode whose bristle tips and reference surface are respectively mounted in an opposed relationship with respect to one another and each of said electrostatic fields are established between the bristle tips of a conductive bristle brush and a conductive reference surface electrode.

3. The apparatus of claim 1, wherein at least one of said first and second electrostatic field generating means includes a pair of conductive bristle brushes whose bristle tips are mounted in an opposed relationship with respect to one another with an electrostatic field being established between said opposed conductive bristle brush tips.

4. The apparatus of claim 1, wherein said first electrostatic charge generating means produces a positive charge on randomly charged web material moved through the electrostatic field produced by said first electrostatic charge generating means and said second electrostatic charge generating means produces a negative uniform charge level on said web material as it is moved through the electostatic field produced by said second electrostatic charge generating means.

5. The apparatus of claim 1, wherein said first electrostatic charge generating means produces a negative charge on randomly charged web material moved through the electrostatic field produced by said first electrostatic charge generating means and said second electrostatic charge generating means produces a positive uniform charge level on said web material as it is moved through the electrostatic field produced by said second electrostatic charge generating means.

6. The apparatus of claim 1, wherein said first electrostatic charge generating means produces a common polarity electrostatic charge on randomly charged web material moved through the electrostatic field produced by said first electrostatic charge generating means and said second charge generating means produces a neutral uniform charge level on said web material as it is moved through the electrostatic field produced by said second electrostatic charge generating means.

7. The apparatus of claim 6, wherein said common polarity charge is positive.

8. The apparatus of claim 6, wherein said common polarity electrostatic charge is negative.

9. A method of establishing a uniform charge level on a randomly charged web having bounded-type electrostatic charges thereon, comprising the steps of:

establishing a first electrostatic field of predetermined polarity and intensity at a particular spatial location;

establishing a second electrostatic field of different intensity and of opposite polarity with respect to said first electrostatic field at a different spatial location; and moving said randomly charged web through said first electrostatic field for the purpose of changing the polarity of either the positive or the negative random elecrostatic web charges and subsequently moving said web from said first electrostatic field and through said second electrostatic field to change the polarity of the electrostatic charge on said web after exposure to said first electrostatic field and to thereby produce a uniform electrostatic charge level on said moving web.

10. The method of claim 9, wherein the polarity of said first electrostatic field is positive and the polarity of said second electrostatic field is negative.

11. The method of claim 9, wherein the polarity of said first electrostatic field is negative and the polarity of said second electrostatic field is positive.

12. Apparatus for establishing a select, generally uniform electrostatic charge level of a web having random bounded-type electrostatic charges thereon, said apparatus comprising:

means for applying to at least a portion of said web a first electrostatic field of a given polarity and sufficient intensity to at least neutralize all electrostatic charges of opposite polarity; and means for subsequently applying to said portion of said web a second electrostatic field of a polarity that is opposite said given polarity and of sufficient intensity to at least neutralize all charges of said given polarity and thereby provide a uniform charge level ranging from neutrality to a selected level of charge of said opposite polarity.

13. The apparatus of claim 12 wherein said first field applying means applies a field intensity sufficient to polarize all charges of said web portion to said given polarity, and said second field applying means applies a field intensity less than said that of said first field applying means.

14. The apparatus of claim 12 including means for advancing said web through said first field applying means and then through said second field applying means.

15. The apparatus of claim 12 wherein said second field applying means applies an electrotatic intensity of approximately one-half that of said first field appying means.

16. A method of establishing a select, generally uniform electrostatic charge level of a web having random bounded-type electrostatic charges, the method comprising the steps of:

establishing a first electrostatic field of a given polarity and sufficient intensity across a portion of said web to at least neutralize all electrostatic charges of said web portion which are of opposite polarity; and subsequently establishing a second electrostatic field of a polarity that is opposite said given polarity and of sufficient intensity across said web portion to at least neutralize all charges of said given polarity and thereby provide a uniform charge level ranging from neutrality to a selected level of charge of said opposite polarity.

17. The method of claim 16 wherein said step of establishing a first field includes establishing a field of sufficient intensity to polarize all oppositely polarized charges to said given polarity.

* * * * *